US006601521B2

(12) United States Patent
Keller et al.

(10) Patent No.: US 6,601,521 B2
(45) Date of Patent: Aug. 5, 2003

(54) TRAVELING CLEANER FOR TEXTILE MANUFACTURING PLANT

(75) Inventors: Arnold Keller, Stallikon (CH); Werner Zemp, Gockhausen (CH); Christian Dürig, Dättwil (CH)

(73) Assignee: Zellweger Luwa AG, Uster (CH)

( * ) Notice: Subject to any disclaimer, the term of this patent is extended or adjusted under 35 U.S.C. 154(b) by 0 days.

(21) Appl. No.: 09/996,247

(22) Filed: Nov. 28, 2001

(65) Prior Publication Data

US 2002/0069786 A1 Jun. 13, 2002

Related U.S. Application Data

(63) Continuation of application No. PCT/CH00/00273, filed on May 17, 2000.

(30) Foreign Application Priority Data

May 28, 1999 (EP) ..... 99110352

(51) Int. Cl.[7] ..... B61D 15/00

(52) U.S. Cl. ..... 105/165; 105/167; 105/169; 104/245; 104/247

(58) Field of Search ..... 104/89, 124, 242, 104/243, 245, 247; 105/148, 149, 157.1, 162, 163.1, 163.2, 165, 167; 15/312.1; 139/1 C

(56) References Cited

U.S. PATENT DOCUMENTS

| | | | | | |
|---|---|---|---|---|---|
| 2,955,546 | A | * | 10/1960 | Liebherr et al. | 105/163.1 |
| 3,159,110 | A | * | 12/1964 | Wylie | 105/163.1 |
| 3,292,559 | A | * | 12/1966 | Cousins et al. | 105/163.1 |
| 4,572,745 | A | * | 2/1986 | House | 134/10 |
| 4,697,298 | A | * | 10/1987 | Mulligan | 15/312.1 |
| 5,269,228 | A | | 12/1993 | Mayer et al. | |
| 5,666,996 | A | | 9/1997 | Bollier et al. | |

FOREIGN PATENT DOCUMENTS

| | | |
|---|---|---|
| DE | 1 098 179 B | 1/1961 |
| DE | 34 00 841 A1 | 7/1985 |
| WO | WO 92/11404 A1 | 7/1992 |

* cited by examiner

*Primary Examiner*—Mark T. Le
(74) *Attorney, Agent, or Firm*—Alston & Bird LLP

(57) ABSTRACT

A traveling cleaner (12) for a textile manufacturing plant, the carriage of which has a carrying structure (18) supported on three running wheels (1, 2, 3). The running wheels (1, 2, 3) are suspended on wheel suspension units (20) and are arranged in a triangle in relation to one another, in such a way that the first running wheel (1) runs on a first rail (14) and the second running wheel (2) and the third running wheel (3) run one behind the other on a second rail (16). The rails (14, 16) form a runway (10) for the traveling cleaner (12) and are arranged next to one another above textile machines of the textile manufacturing plant.

16 Claims, 3 Drawing Sheets

TRAVELING CLEANER FOR TEXTILE MANUFACTURING PLANT

CROSS REFERENCE TO RELATED APPLICATION

This is a continuation of international application PCT/CH00/00273, filed May 17, 2000, and designating the U.S.

BACKGROUND OF THE INVENTION

The present invention relates to a traveling cleaner for a textile manufacturing plant and which is mounted for movement along rails positioned above the textile machines in the plant.

Dust pollution in textile manufacturing plants is significant, with the result that the textile machines of the plants are considerably contaminated. This is detrimental to the quality of the products and increases the risk of operating failures.

In order to overcome this problem, the rooms in which the textile machines stand are air-conditioned and the air is constantly cleaned. Also, use is made of traveling cleaners which are movable on rails extending above the textile machines and which clean the individual textile machines with the aid of specifically directed air streams. Arranged for this purpose on a traveling cleaner carriage moving on the rails, are a fan which generates the air flow and which is driven by a fan motor. Also, a drive motor is provided for moving the carriage on the rails. In order to guide the blowing streams and/or suction streams specifically onto those points of the textile machines which cause problems, hoses and pipes oriented away from the carriage in the direction of the textile machines are provided, as is described, for example, in EP-B1-0 646 192.

Since traveling cleaners must also be capable of being guided along routes containing bends, the rails lie next to one another with a small gage. This small gage often leads to stability problems, particularly when bends are negotiated, by reason of a high center of gravity of the motors arranged on the carriage and the centrifugal force acting on the hoses and pipes.

It is accordingly an object of the present invention to provide a traveling cleaner which has a simple construction so as to facilitate its fabrication, and which is stable even when traveling along bends.

SUMMARY OF THE INVENTION

The above and other objects and advantages of the invention are achieved by the provision of a traveling cleaner which is mounted for movement along first and second rails, and wherein the carrying structure which supports the carriage of the cleaner runs on only three running wheels which are arranged in the corners of a triangle. A first running wheel runs on the running surface of the first rail, and a second running wheel and a third running wheel run one behind the other on a running surface of the second rail which is arranged next to the first rail.

The carrying structure is mounted, at least on the second and the third running wheel, so as in each case to be rotationally movable about an axis of rotation running approximately at right angles to the plane of movement defined by the running surfaces of the rails. By virtue of this arrangement, static overdefinition is avoided, and a larger gage can be selected, thus increasing the stability of the traveling cleaner during movement along the rail and especially on the bends.

It is particularly advantageous for the first running wheel to be driven via a motor and for the two running wheels running on the second rail to be mounted for free movement. A differential may thereby be dispensed with in the drive. Moreover, as compared with a four wheel support, there is a higher bearing force on the driven first running wheel and therefore a better transmission of the drive torque.

The bearing force and the drive torque transmission are also improved when approximately half the weight of the carriage is supported on the first running wheel.

By means of guide wheels engaging, preferably on both sides, on guide surfaces of the rails, the running wheels of the carriage are held on the running surfaces of the rails. The torque occurring as a result of the one sided drive is absorbed in a simple way by the lateral guide wheels and the running of the traveling cleaner is stabilized.

With the aid of sensors which cooperate with a control system regulating the speed of the traveling cleaner, an automatic detection of bends and the negotiation of these at reduced speed are possible, so that the centrifugal forces acting on hoses and pipes are reduced and travel on bends is stabilized.

BRIEF DESCRIPTION OF THE DRAWINGS

The invention is explained below by way of example with reference to the accompanying schematic drawings, in which.

DETAILED DESCRIPTION OF THE PREFERRED EMBODIMENTS

Figure 1:
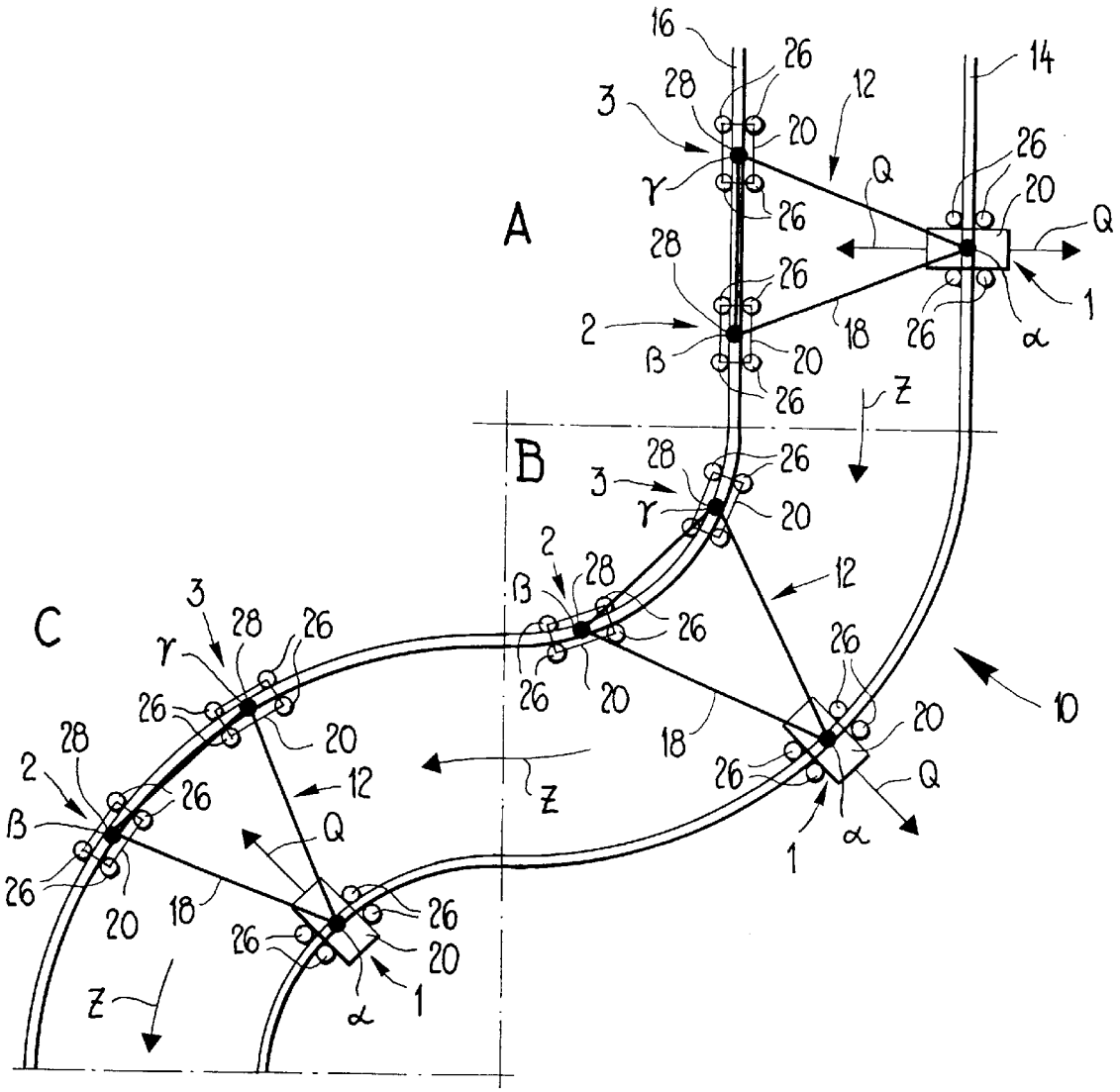
FIG. 1 is a top view of a portion of a runway formed by two rails arranged next to one another, with a traveling cleaner in three different positions on this runway. In this illustration, only a triangular carrying structure of the carriage of the traveling cleaner and wheel suspension units of its running wheels are shown.

FIG. 1 shows a portion of a runway 10 for a textile traveling cleaner 12, the runway being formed by a first rail 14 and a second rail 16 which are arranged next to one another. The rails extend above textile machines as shown schematically in FIG. 2. A triangular carrying structure 18 of a carriage of a traveling cleaner 12 is illustrated in three different positions A, B, C on the rails 14, 16, with the carrying structure being supported at its corner points $\alpha$, $\beta$, $\gamma$, on a running wheel 1, 2, 3 respectively.

The running wheels 1, 2, 3 are arranged on wheel suspension units 20 and therefore are not illustrated explicitly in FIG. 1. In the same way as the corner points ($\alpha$, $\beta$, $\gamma$, of the carrying structure 18), the running wheels 1, 2, 3, are also arranged in a triangle in relation to one another on their wheel suspension units 20, so that a first running wheel 1 runs on the first rail 14 and a second running wheel 2 and a third running wheel 3 run one behind the other on the second rail 16.

Figure 2:
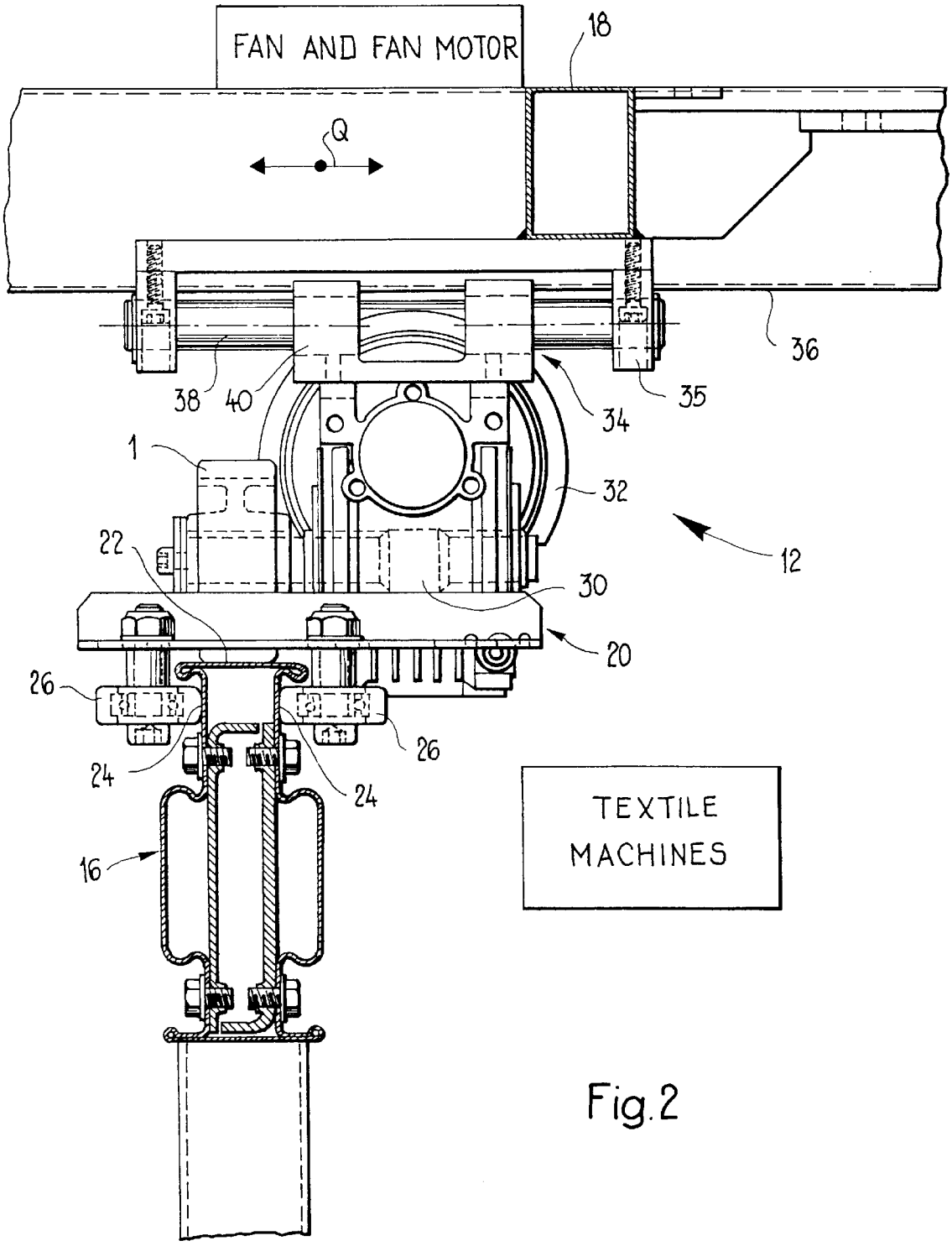
FIG. 2 is a sectional view taken through the first of the two rails forming the runway, with a first running wheel driven by a motor.
Figure 3:
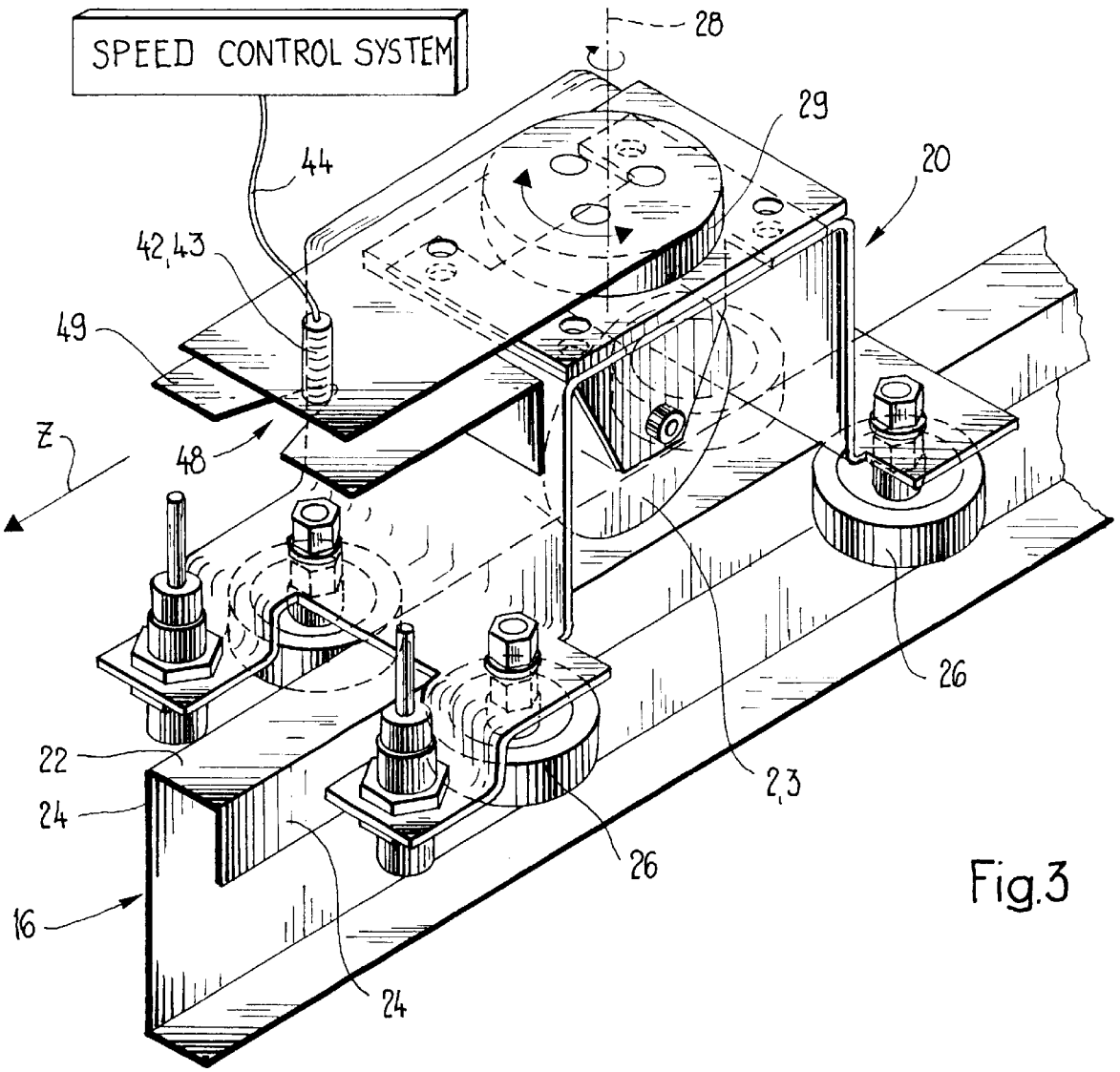
FIG. 3 is a perspective view of a wheel suspension unit which is mounted for rotation relative to the carrying structure about an axis of rotation arranged at right angles to the plane of movement defined by the running surfaces of the rails, and which has, for bend detection, an induction sensor cooperating with an induction element.

As is evident from FIGS. 2 and 3, the running wheels 1, 2, 3 run on upper running surfaces 22 of the rails 14, 16, while free running guide wheels 26 engage on lateral guide surfaces 24 of the rails 14, 16 which are arranged at right angles to the running surfaces 22, in order, for example, to absorb a torque occurring due to a one sided drive and stabilize the running of the traveling cleaner 12. The guide wheels 26 also prevent the running wheels 1, 2, 3 from coming off from the running surfaces 22 of the rails 14, 16 during travel. Each wheel suspension unit 20 has four such guide wheels 26, of which two guide wheels 26 are arranged in each case in front of and behind the running wheel 1, 2, 3 in the direction of movement Z, so as to engage on the mutually opposite guide surfaces 24 of the rails 14, 16.

As is evident from FIG. 1, the carrying structure 18 of the carriage of the traveling cleaner 12 is supported for rotation movement on the wheel suspension units 20 of the second and third running wheels 2, 3 in each case about an axis of rotation 28 which extends approximately at right angles to the plane of movement defined by the running surfaces 22 of the rails 14, 16. The rotational movability is made possible by a rotary member 29, for example in the form of a ball bearing, between the carrying structure 18 and the wheel suspension unit 20, as is illustrated in FIG. 3.

By contrast, the carrying structure 18 is connected to the wheel suspension unit 20 of the first running wheel 1 without relative rotation being possible. This design allows very good force transmission between the first running wheel 1 on the first rail 14 and the second and third running wheels 2, 3 on the second rail 16 and increases the stability during travel on bends. Good force transmission is particularly important when, as in the above example, the drive takes place on only one rail. The advantage of such a drive is that there is no need for a differential. In this example, as illustrated in FIG. 2, the first running wheel 1 is driven by a motor 32 via a gear 30.

How the carrying structure 18 rotates relative to the wheel suspension units 20 of the second and third running wheels 2, 3 during travel on bends, can be seen clearly in the comparison of the individual positions A straight ahead, B bend to the right, C bend to the left which are illustrated in FIG. 1. However, instead of the rotationally fixed connection between the carrying structure 18 and the wheel suspension unit 20 of the first running wheel 1, a rotationally movable connection, as in the case of the second and third running wheels 2, 3, may also be envisaged.

So that the distance of the running wheel 1 from the second rail 16, which changes during travel on bends, can be compensated, the wheel suspension unit 20 of the first running wheel 1 is displaceable in the direction Q transversely to the direction of movement Z of the carriage 36 with the aid of a displacement device 34, as is indicated in FIG. 1 by the arrows Q. The displacement device 34 is illustrated in more detail in FIG. 2, and it has a guide rail 38 fastened to the carrying structure 18 of the carriage 36 of the traveling cleaner 12 and a slide 40 which is movable back and forth in the direction Q on the guide rail 38 and to which the wheel suspension unit 20 of the running wheel 1 is fastened. In this example, the guide rail 38 is connected to the carrying structure 18 by means of bolted on rail brackets 35, but other connections, for example by means of rivets or welding, may also be envisaged. In order to obtain as good a transmission of the drive torque as possible to the first running wheel 1, the drive motor 32 and the gear 30 are also connected fixedly to the wheel suspension unit 20 of the first running wheel 1 and are displaceable, together with the wheel suspension unit, in the direction Q with the aid of the displacement device 34.

Due to the large gage, the fan motor and the fan as shown schematically in FIG. 2 may also be arranged on the carriage 36 of the traveling cleaner 12, for example between the running wheels 1, 2, 3, in such a way that a low center of gravity is obtained and at least approximately half the total weight of the traveling cleaner 12 rests on the first running wheel 1, thus resulting in a very good transmission of the drive torque.

In order to increase the stability during travel on bends, the centrifugal forces acting on pipes and hoses of the traveling cleaner 12 should be reduced. Automatic bend detection, which cooperates with a control system for speed regulation, ensures a negotiation of bends at reduced speed and therefore a lower centrifugal force and higher stability.

FIG. 3 illustrates by way of example a sensor 42 cooperating with a counterelement 41. The sensor 42 for bend detection is shown to be an induction sensor 43 with a signal lead 44 to a control system, not illustrated, and the counterelement 41 is shown to be an induction element 46. The induction sensor 43 is arranged so as to be fixed to the carrying structure and is located opposite the induction element 46 which is designed as a slotted plate 45 and which is rotatable, together with the wheel suspension unit 20, relative to the induction sensor 43 about the axis of rotation 28. During travel straight ahead, the induction sensor 43 is located opposite a slot 48 of the slotted plate 45, 46 and there is no signal induced in the induction sensor 43. During travel on a bend, the wheel suspension unit 20 is rotated relative to the induction sensor 43 fixed to the carrying structure and a tongue 49 of the slotted plate 45 is moved into the region of the induction sensor 43, so that a signal is induced. This signal is transmitted via the signal lead 44 from the sensor 42, 43 to the control system and the speed is reduced, such that the bends are negotiated slowly. After the bends have been negotiated, when the induction sensor 43 is located above the slot 48 again, the speed is increased again.

In the example shown, sensors 42, 43 and counterelements 41, 45, 46 are arranged above the second and third running wheels 2, 3 for automatic bend detection. In travel straight ahead, the sensors 42, 43 of the two running wheels 2, 3 are located above the slots 48, while, in travel on a bend, at least one sensor is located above a tongue 49 of the slotted plate 45 and a signal is induced, this leading to a speed reduction by means of the control system.

A tongue-like plate located opposite the induction sensor 43 may also be envisaged as the induction element 46, SO that the induction sensor 43 is located above the plate only in travel straight ahead and no counterelement 41, 46 is located opposite the sensor 42, 43 during travel on a bend. Also, conversely to the illustration in FIG. 3, the sensor may be fastened to the wheel suspension unit 20 and the counterelement 41, 46 be located opposite the sensor 42, 43 so as to be fixed to the carrying structure. Moreover, instead of the induction sensor 43, optical sensors 42 or the like may also be envisaged. Elements which are fastened to the rails 14, 16 may also be envisaged as counterelements 41.

What is claimed is:

1. A traveling cleaner for a textile manufacturing plant, comprising first and second rails arranged adjacent each other and extending above textile machines of the manufacturing plant, with the first and second rails each having an upper running surface extending therealong, and a carriage of a traveling cleaner having a carrying structure supported for movement along the rails and comprising running wheels arranged to run on the running surfaces of the first and second rails, with the running wheels arranged at the corners of a triangle with a first running wheel running on the running surface of the first rail and second and third running wheels arranged one behind the other to run on the running surface of the second rail, and with at least the second and third running wheels being rotationally moveable about axes of rotation which extend approximately at right angles to a plane of movement defined by the running surfaces of the rails, and wherein the first running wheel is driven by a motor and the second and third running wheels are free running.

2. The traveling cleaner as claimed in claim 1, wherein the first running wheel is connected to the carrying structure of the carriage so as to be displaceable in a direction transverse to the direction of movement of the carriage for gage compensation during travel on a bend.

3. The traveling cleaner as claimed in claim 1, wherein at least approximately half the weight of the carriage is supported on the first running wheel.

4. The traveling cleaner as claimed in claim 1, wherein each running wheel is arranged on a wheel suspension unit which mounts freely rotatably guide wheels which engage on lateral guide surfaces on both sides of the associated rail, and which prevent the running wheels from leaving the running surfaces of the rails.

5. The traveling cleaner as claimed in claim 1, wherein at least one of the second and third running wheels is mounted on a wheel suspension unit which is mounted to the carrying structure so as to permit relative rotation about its associated one of said axes of rotation, and further comprising a sensor for the detection of bends in the rails, and a control system cooperating with the sensor for regulating the speed of the traveling cleaner so as to permit driving through the bends at reduced speed.

6. The traveling cleaner as claimed in claim 5, wherein the sensor is arranged so as to be fixed to the carrying structure of the wheel suspension unit of said one running wheel, and said sensor cooperates with a counterelement in such a way that, during a rotation of said wheel suspension unit out of the position assumed in relation to the carrying structure during travel straight ahead, a signal which is capable of being transmitted to the control system and which indicates travel on a bend is generated.

7. The traveling cleaner as claimed in claim 6, wherein a sensor is assigned in each case to the second and the third running wheels, and, when travel on a bend is indicated by means of one of these sensors, the speed of the traveling cleaner is reduced by means of the control system.

8. The traveling cleaner as claimed in claim 1, further comprising a fan motor and a fan operated by the fan motor, for generating cleaning-air flows of the traveling cleaner, with the fan motor and fan being arranged between the running wheels on the carriage.

9. The traveling cleaner as defined in claim 2 wherein the first running wheel defines an axis of rotation, and wherein said direction traverse to the direction of movement of the carriage is linear and parallel to the axis of rotation defined by the first running wheel.

10. A traveling cleaner for a textile manufacturing plant, comprising first and second rails arranged adjacent each other and extending above textile machines of the manufacturing plant, with the first and second rails each having an upper running surface extending therealong, and a carriage of a traveling cleaner having a carrying structure supported for movement along the rails and comprising three running wheels arranged to run on the running surfaces of the first and second rails, with the running wheels arranged at the corners of a triangle with a first running wheel running on the running surface of the first rail and second and third running wheels arranged one behind the other to run on the running surface of the second rail, wherein each running wheel is mounted to a wheel suspension unit which is in turn mounted to the carrying structure, with the suspension units which mount the second and third running wheels being mounted for relative rotation with the carrying structure about respective axes of rotation which are approximately at right angles to a plane of movement defined by the running surfaces of the rails, and with the suspension unit which mounts the first running wheel being fixed to the carrying structure so as to preclude such rotation, and wherein the suspension unit which mounts the first running wheel mounts a motor which is operatively connected for driving the first running wheel, and wherein the second and third running wheels are free running.

11. The traveling cleaner as claimed in claim 10, wherein the suspension unit which mounts the first running wheel is connected to the carrying structure so as to be displaceable in a direction transverse to the direction of movement of the carriage along the rails.

12. The travel cleaner as defined in claim 11 wherein the first running wheel defines an axis of rotation, and wherein said direction traverse to the direction of movement of the carriage is linear and parallel to the axis of rotation defined by the first running wheel.

13. The traveling cleaner as claimed in claim 11, further comprising a fan motor and a fan operatively connected to the fan motor being mounted upon the carriage.

14. A traveling cleaner for a textile manufacturing plant, comprising first and second rails arranged adjacent each other and extending above textile machines of the manufacturing plant, with the first and second rails each having an upper running surface extending therealong, and a carriage of a traveling cleaner having a carrying structure supported for movement along the rails and comprising running wheels arranged to run on the running surfaces of the first and second rails, with the running wheels arranged at the corners of a triangle with a first running wheel running on the running surface of the first rail and second and third running wheels arranged one behind the other to run on the running surface of the second rail, and with at least the second and third running wheels being rotationally moveable about axes of rotation which extend approximately at right angles to a plane of movement defined by the running surfaces of the rails, and wherein at least one of the second and third running wheels is mounted on a wheel suspension unit which is mounted to the carrying structure so as to permit relative rotation about its associated one of said axes of rotation, and further comprising a sensor for the detection of bends in the rails, and a control system cooperating with the sensor for regulating the speed of the traveling cleaner so as to permit driving through the bends at reduced speed.

15. The traveling cleaner as claimed in claim 14, wherein the sensor is arranged so as to be fixed to the carrying structure of the wheel suspension unit of said one running wheel, and said sensor cooperates with a counterelement in such a way that, during a rotation of said wheel suspension unit out of the position assumed in relation to the carrying structure during travel straight ahead, a signal which is capable of being transmitted to the control system and which indicates travel on a bend is generated.

16. The traveling cleaner as claimed in claim 15, wherein a sensor is assigned in each case to the second and the third running wheels, and, when travel on a bend is indicated by means of one of these sensors, the speed of the traveling cleaner is reduced by means of the control system.

* * * * *